US005499815A

United States Patent [19]

Attaya

[11] Patent Number: 5,499,815

[45] Date of Patent: Mar. 19, 1996

[54] MAZE

[76] Inventor: Samuel D. Attaya, 41 W. Torch Pine, The Woodlands, Tex. 77381

[21] Appl. No.: 421,829

[22] Filed: Apr. 13, 1995

Related U.S. Application Data

[63] Continuation-in-part of Ser. No. 250,905, Jun. 22, 1994, Pat. No. 5,409,223.

[51] Int. Cl.[6] ..... A63F 7/04

[52] U.S. Cl. ..... 273/109; 273/118 R

[58] Field of Search ..... 273/153 R, 108, 273/109, 118 R, 113, 117

[56] References Cited

U.S. PATENT DOCUMENTS

| | | | |
|---|---|---|---|
| 3,540,731 | 11/1970 | Muncey | 273/109 |
| 3,787,054 | 1/1974 | Stafford | 273/109 |
| 4,861,036 | 8/1989 | Watanabe | 273/109 X |
| 5,145,174 | 9/1992 | Caramanoff | 273/109 |
| 5,314,181 | 5/1994 | Lin | 273/109 |
| 5,409,223 | 4/1995 | Attaya | 273/109 |

FOREIGN PATENT DOCUMENTS

| | | | |
|---|---|---|---|
| 1433257 | 12/1966 | France | 273/109 |
| 1292591 | 10/1972 | United Kingdom | 273/109 |

*Primary Examiner*—William E. Stoll
*Attorney, Agent, or Firm*—Guy McClung

[57] ABSTRACT

A maze unit containing a user-defined maze path and a ball or marble movable therethrough is disclosed. In one aspect, the top of the maze unit, or part of it, is covered so that the user relies upon verbal instructions provided by a second person who is familiar with or has recorded the internal maze path as to the direction in which to tip or tilt the unit so that the ball or marble follows the correct path to a predetermined exit. In one embodiment two or more maze units are stacked, one on top of the other, with aligned exit and entry holes so that a ball or marble that successfully traverses an upper unit falls into an entry point of a lower unit. In another aspect two or more maze units are interconnected end-to-end on the same level. Methods are disclosed for the use of such mazes in a variety of didactive scenarios.

19 Claims, 4 Drawing Sheets

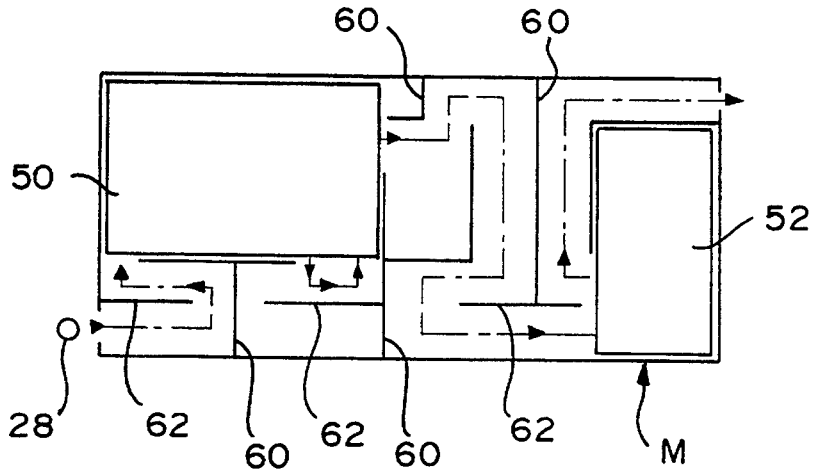
FIG. 7
FIG. 8
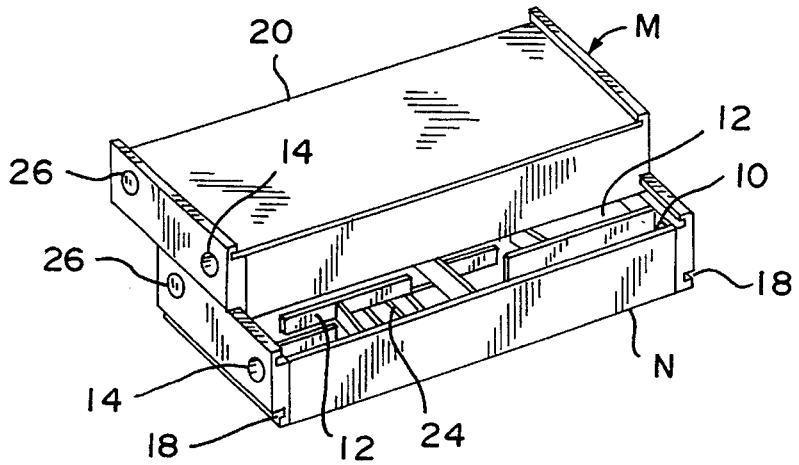
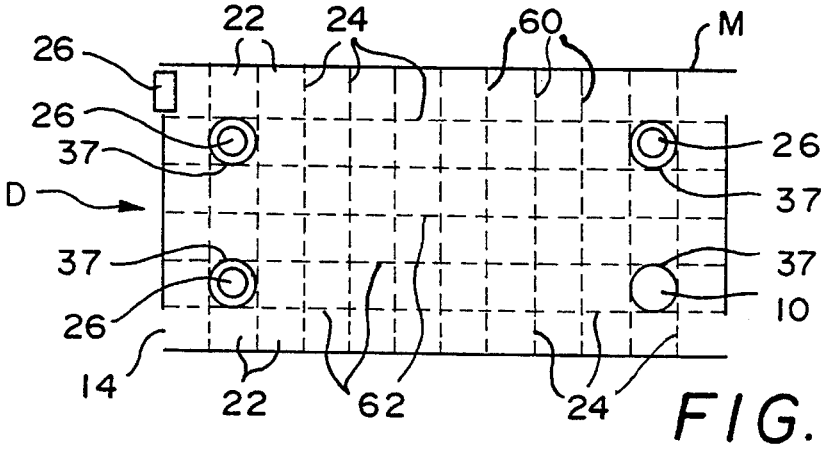
FIG. 9

MAZE

RELATED APPLICATION

This is a continuation-in-part of U.S. application Ser. No. 08/250,905 filed on Jun. 22, 1994 now U.S. Pat. No. 5,409,223, entitled "Maze" and co-owned with this application and invention.

BACKGROUND OF THE INVENTION

1. Field of the Invention

This invention relates to mazes and maze-like configurations. In one maze according to the present invention a ball or marble is moved from a first point to a second point through a predesigned maze path.

2. Description of Related Art

Ancient mazes were built as antechambers to the pyramids. These maze paths produced a very difficult pathway for intruders to invade the holy resting place of a king or high official inferred within. More recently, scientists have used mazes to study the behavior of animals.

U.S. Pat. No. 3,540,731 discloses a puzzle maze with movable partitions which slide in and out on tracks in a base plate.

U.S. Pat. No. 3,787,054 discloses a maze puzzle cubicle with nontransparent walls and a pair of transparent windows. A ball is moved from a start window, through an unseen maze path within the cubicle, to an exit window. In one aspect all the walls are transparent.

U.S. Pat. No. 4,861,036 discloses a multi-level maze toy formed of nine kinds of single cube maze elements with passageways through them for a ball.

U.S. Pat. No. 5,145,174 discloses a maze puzzle with a ball that moves through a labyrinthine maze path which is obscured by an opaque screen.

U.S. Pat. No. 5,314,181 discloses a toy with a plurality of paths for a plurality of balls with interconnected lamps indicating stages in an effort to move the balls through the paths.

SUMMARY OF THE PRESENT INVENTION

The present invention, in one aspect, discloses a maze unit with a box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom. There are a plurality of slots in the top surface of the bottom, the slots suitable for receiving and releasably holding a plurality of maze dividers which are removably disposed in the slots to form a maze path for a ball or marble to follow from an entry point to an exit point. In one aspect, the maze dividers are removable from the slots and re-positionable therein to form a different maze path. In one aspect such a maze has slots which include a first series of slots spaced apart from each other and a second series of slots spaced apart from each other, the first series of slots parallel to each other, and the second series of slots parallel to each other and at angles to the slots of the first series of slots. In one aspect the angle is a right angle.

In one embodiment an opaque cover is removably disposed over the box to prevent a person from observing the marble as it moves through the maze unit, and the box has a marble entry point at one location and a marble exit point at another. In one aspect a cover over the box may be opaque in one or more areas covering only one or more selected parts of the maze.

In another embodiment of such mazes according to the present invention one such maze box is stacked on another such maze box so that a ball or marble exit point of the top maze box corresponds to a ball or marble entry point of the lower maze box. In this way a ball or marble moved successfully through a maze in the top maze box enters and is then movable through the lower maze box. It is within the scope of this invention for any number of maze boxes to be stacked one on top of the other in this manner. In one aspect complementary tongue and groove joints are used to secure one maze box on top of another.

In another aspect of a maze according to the present invention a template or drawing is provided to a person which represents the pattern of slots, ball entry points, and ball exit points for the maze. Such a template or drawing may be used to design a maze path for a maze box as previously described. A set of directions can be written for moving a ball along the designed maze path.

In certain embodiments the present invention discloses methods for using mazes as described above to teach a person to visualize and conceptualize a maze path; to write down a method for traversing such a path; to instruct another person to traverse the path; and to race another person through a maze path.

It is, therefore, an object of at least certain preferred embodiments of the present invention to provide new, useful, unique, efficient, nonobvious maze units and methods for their use.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIG. 7 is a top plan view of the maze of FIG. 6 with opaque plates covering part of the maze.

FIG. 8 is a front perspective view of a system with two maze boxes according to the present invention.

FIG. 9 is a schematic representation of a design aid which shows slots of the maze of FIG. 1.

DESCRIPTION OF EMBODIMENTS PREFERRED AT THE TIME OF FILING FOR THIS PATENT

Figure 1:
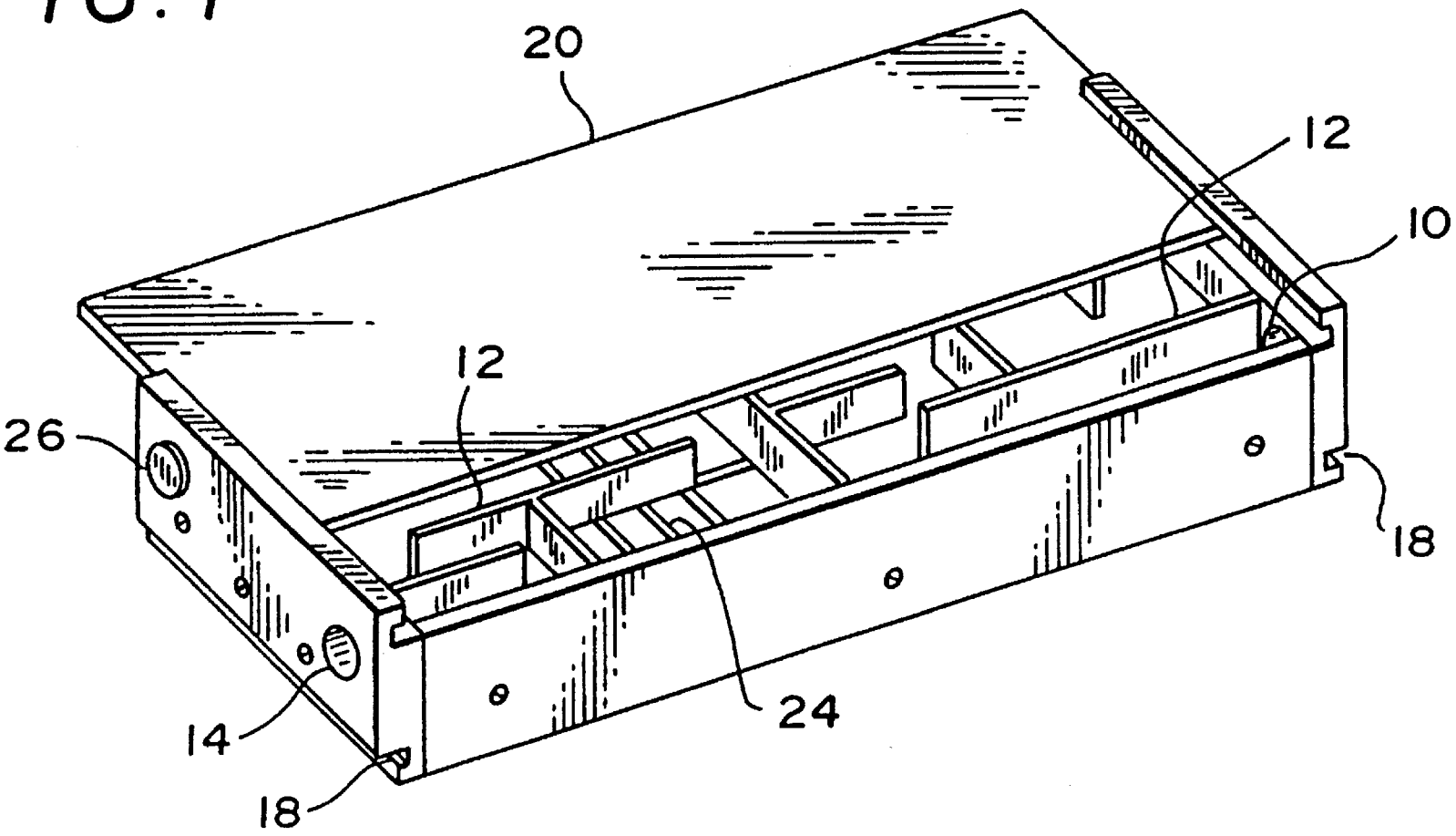
FIG. 1 is a perspective view of a maze according to the present invention.
Figures 2, 3, 4:
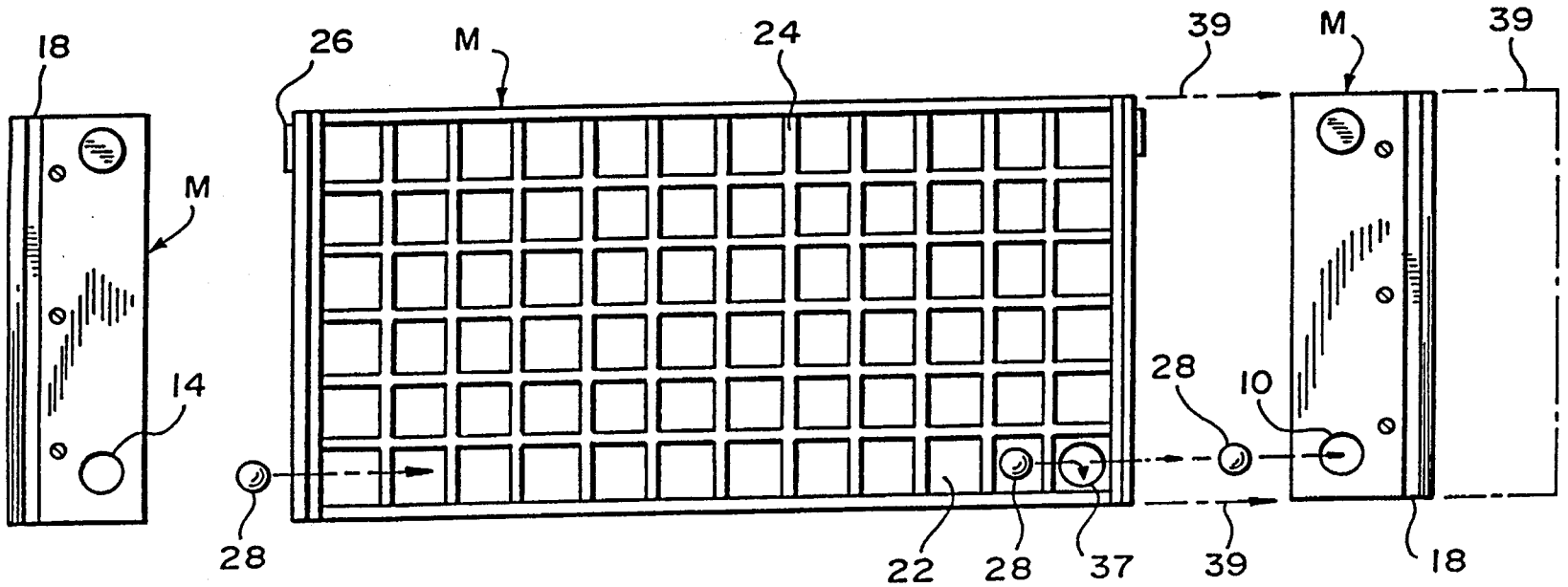
FIG. 2 is an end view of a first end of the maze of FIG. 1.
FIG. 3 is a top plan view of the maze of FIG. 1 with a top cover removed.
FIG. 4 is an end view of a second end of the maze of FIG. 1.

FIGS. 1–4 illustrate a maze unit M according to the present invention with an opaque top cover 20 partially open to reveal maze dividers 12, an entry point of a marble through a hole 14, an exit point 10, and one or more plugs 26 to block holes not used in the given maze configuration (see, e.g. FIG. 9). Slots 18 provide attachment for an additional maze unit N below the first unit M. A hole 37 is used when two (or more) maze units are stacked together so a ball or marble 28 drops through the hole 37 to a next lower maze unit N (or in another embodiment to another maze box connected at the same level in line with the first maze unit M through a hole 10 with the hole 37 plugged). In another embodiment the top cover 20 is transparent or is deleted entirely. It is within the scope of this invention to have a plurality of holes 37 at any desired location in the maze; see, e.g. FIG. 9.

A plurality of saw cuts or slots 24 extending lower than a plurality of raised portions 22 provide receptacles for receiving and holding a portion of a maze divider 12.

Figure 5:
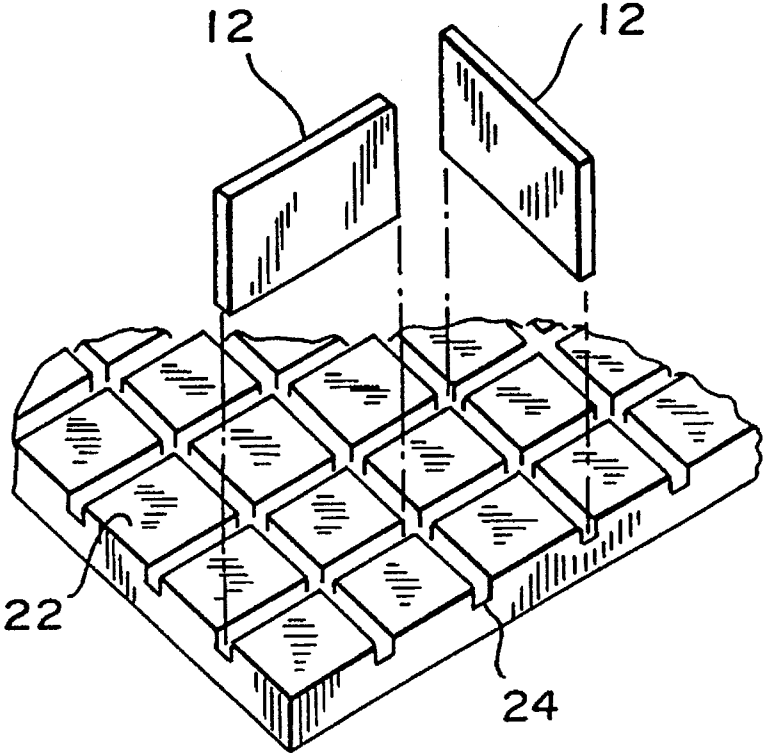
FIG. 5 is a perspective view of a portion of the bottom of the maze of FIG. 1.

FIG. 5 illustrates the installation and removal of the maze dividers 12 into and from the slots 24. An assortment of maze dividers 12 of various lengths are supplied with each maze unit so that the maze designer/user may create a limitless number of maze-path options.

Figure 6:
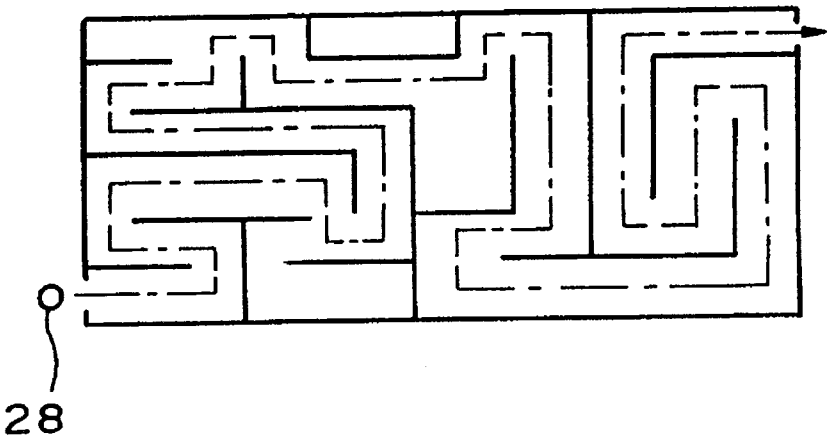
FIG. 6 is a top plan view of a possible maze path for the maze of FIG. 1.

FIG. 6 is a typical maze diagram, illustrating that either the user or a person giving the verbal instructions can design his or her own maze with its own maze path. In the embodiment of FIG. 7 opaque plates 50 and 52 cover part of the maze path of the maze of FIG. 6. The plates 50 and 52 may simply rest on the maze or they may be releasably or permanently secured thereto by any suitable means. One opaque plate may cover the entire maze.

FIG. 9 shows a schematic drawing D which represents a slot pattern for a maze unit M as shown in FIG. 1 (but with multiple holes, 37). A maze path may be sketched onto the drawing D. Such a pattern drawing may be produced for any maze unit and any slot pattern according to the present invention.

As shown in the embodiments of FIGS. 7 and 9 a first series of slots 60 for maze dividers are parallel to each other and second series of slots 62 are parallel to each other. In this embodiment the slots of the first series of slots 60 are at right angles to the slots of the second series of slots 62. It is within the scope of this invention to have a first series of parallel slots at any desired angle to a second series of slots. It is also within the scope of this invention to employ non-straight slots and non-straight maze dividers. In one aspect such slots have a wavy appearance and the dividers have a complementary wavy shape for insertion into the wavy slots. In another embodiment both straight and non-straight slots and straight and non-straight dividers are present in one maze.

In one method according to the present invention using a maze as described above, a game is provided in which one, or two or more maze players each sketch a maze pattern on one of the drawings (as in FIG. 9). Each player, in teams or alone, then attempts to determine the directions in which a real maze would be moved in order to guide a marble from an entrance to an exit of the designed maze. Each player records a set of directions independently. Maze walls are then inserted into an actual maze slot grid according to the previously created pattern on the drawing; then each player in turn tests the accuracy of her or his directions. This game teaches conceptualizing tasks before engaging in an activity itself, permitting a player to test the accuracy of concepts versus what exists in the real world.

In another method according to the present invention, a maze is used so that the player cannot see the maze path, either due to the player's position or due to a cover over the maze unit. An instructor who can either see the maze path or who uses prerecorded directions (untested or pre-tested), e.g. "left", "right", "up", or "down", to direct the player in moving the maze box to guide the ball or marble from an entrance to an exit. The ability to follow instructions blindly and with exactness is developed by the player.

In another embodiment of a method according to the present invention, without holding a maze, two players take turns randomly selecting tilting directions, which are recorded. Each player then uses the same set of written instructions to create a maze which complies with the randomly vocalized directions. The "winner" is the player who completes a successfully working maze in the shortest time.

In another embodiment of a method according to the present invention, a player designs a maze so that two or more marbles, inserted at different holes in the maze [e.g. in one embodiment there are a total of eight openings in the maze; note there may be any desired number of entrance(s) and exit(s) in any maze according to this invention] reach exits simultaneously.

In certain embodiments of any method or game described herein, multiple maze units may be used in series connected together end-to-end or in a multi-level configuration. Additional levels may be stacked vertically, the ball or marble gaining access to the next lower level through one of one or more openings in the bottom of the level in which it moves.

In another method according to this invention, a player may create a course of his or her own design or use a predesigned pattern provided with the unit to compete with other maze players for the quickest time. Alternatively, two (or more) identical mazes may be used by two (or more) players simultaneously whose performances are timed.

In another embodiment of a method according to the present invention, a maze unit with a set divider pattern is shown to two players. Then one of the players removes one or more wall sections from the maze unit and provides directions to the second player (or more) to guide a marble from an entrance to an exit based upon the state of the maze prior to the removal of the wall section. The object of the game is to have the second player ascertain which wall section(s) were removed.

In another embodiment a maze unit according to the present invention with a cover in place (opaque or transparent) is turned on end so that its maze walls become horizontal surfaces upon which a marble rolls.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112.

What is claimed is:

1. A method for teaching a first person to follow directions from a second person, the second person holding a maze unit with a maze path therein traversable by a ball insertable into an entry hole for the maze path, the ball movable from the entry hole through the maze path to an exit hole, the method comprising inserting the ball into the entry hole, and the second person giving a series of directions to the first person telling the first person how to move the maze unit to successfully move the ball through the maze path and out from the exit hole.

2. The method of claim 1 wherein the maze unit comprises a box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a ball to follow from the entry point to the exit point, the slots including a first series of slots spaced apart from each other and a second series of slots spaced apart from each other, the first series of slots parallel to each other, and the second series of slots parallel to each other and at an angle to the slots of the first series of slots, and a ball movable through the maze unit.

3. The method of claim 2 wherein the maze unit further comprises the plurality of maze dividers removable from the slots and re-positionable therein to form a different maze path.

4. The method of claim 3 wherein the maze unit further comprises an opaque cover removably disposed over the box to prevent a person from observing the ball as it moves through the maze unit.

5. The method of claim 4 wherein the maze unit further comprises a ball entry point at one location of the box and a ball exit point at another location in the box.

6. The method of claim 1 further comprising the second series of slots at a right angle to the slots of the first series of slots.

7. A method for using a maze unit, the maze unit comprising a box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a ball to follow from the entry point to the exit point, the plurality of maze dividers removable from the slots and re-positionable therein to form a different maze path, the slots including a first series of slots spaced apart from each other and a second series of slots spaced apart from each other, the first series of slots parallel to each other, and the second series of slots parallel to each other and at an angle to the slots of the first series of slots, a ball movable through the maze unit, the maze dividers defining a maze path through the maze for the ball, the method comprising a first person who knows the maze path instructs a second person who does not know the maze path, the first person telling the second person how to move the maze unit to effect movement of the ball along the maze path to an end point of the maze.

8. The method of claim 7 wherein the maze unit has a ball entry hole at a beginning of the maze path for insertion of the ball into the maze unit and a ball exit hole at an end point of the maze path for exit of the ball from the maze unit.

9. The method of claim 7 further comprising covering the maze path with an opaque cover so that the first person cannot see the maze path.

10. A method for using a maze unit, the maze unit comprising a box with slots in a bottom thereof for receiving and holding maze dividers which are insertable into the slots to define a maze path in the box, a ball movable along the maze path from a first point to a second point, the method comprising providing at least one player with a drawing representation of the bottom of the box and the slots, the at least one player drawing a maze path on the drawing representation of the bottom of the box, the at least one player then preparing a set of movement directions for moving a ball along the maze path shown on the drawing representation of the bottom of the box, inserting maze dividers into the slots to produce the maze path shown on the drawing representation, and moving a ball according to the set of movement directions along the maze path.

11. The method of claim 10 wherein the maze unit further comprises a box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a marble to follow from the entry point to the exit point, the plurality of maze dividers removable from the slots and re-positionable therein to form a different maze path, the slots including a first series of slots spaced apart from each other and a second series of slots spaced apart from each other, the first series of slots parallel to each other, and the second series of slots parallel to each other and at an angle to the slots of the first series of slots, the maze dividers defining a maze path through the maze unit.

12. A maze comprising a first maze unit and a second maze unit interconnected with the first maze unit, the first maze unit comprising a first box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a ball to move along, the plurality of maze dividers removable from the slots and re-positionable therein to form a different maze path, the slots including a first series of slots spaced apart from each other and a second series of slots spaced apart from each other, the first series of slots parallel to each other, and the second series of slots parallel to each other and at an angle to the slots of the first series of slots, a ball movable through the first maze unit, a first ball exit point at a first location in the first box, the maze dividers defining a first maze path in the first box, the second maze unit comprising a second box having a bottom, the bottom having a top surface and a first end spaced apart from a second end and a first side spaced apart from a second side, a first end wall extending upwardly from the first end of the bottom, a second end wall extending upwardly from the second end of the bottom, a first side wall extending upwardly from the first side of the bottom and a second side wall extending upwardly from the second side of the bottom, a plurality of slots in the top surface of the bottom, the slots suitable for receiving and releasably holding maze dividers, a plurality of maze dividers removably disposed in the slots and forming a maze path for a ball to move along, the plurality of maze dividers removable from the slots and re-positionable therein to form a different maze path, the slots including a first series of slots spaced apart from each other and a second series of slots spaced apart from each other, the first series of slots parallel to each other, and the second series of slots parallel to each other and at an angle to the slots of the first series of slots, the ball movable through the second maze unit, the maze dividers defining a second maze path in the second box, a second ball entry point at one location of the second box, the second ball entry point positioned to receive the ball into the second maze unit when the ball exits from the first ball exit point of the first maze unit.

13. The maze of claim 12 wherein the first maze unit is on top of the second maze unit.

14. The maze of claim 12 wherein the first maze unit and the second maze unit are side by side on the same level.

15. The maze of claim 14 further comprising an opaque cover on the first box to prevent a person from seeing the first maze path, and an opaque cover on the second box to prevent a person from seeing the second maze path.

16. The maze of claim 12 further comprising an opaque cover on the first box to prevent a person from seeing the first maze path.

17. The maze of claim 12 wherein the bottom of each box is transparent.

18. The maze of claim 12 wherein in each box the first series of slots is at a right angle to the second series of slots.

19. The maze of claim 12 wherein the first box has a ball entry hole and the second box has a ball exit hole.

* * * * *